US006925652B2

(12) United States Patent
Feng

(10) Patent No.: US 6,925,652 B2
(45) Date of Patent: Aug. 9, 2005

(54) DIVING VEST WITH ADJUSTABLE BUOYANCY

(76) Inventor: Peter Feng, No. 22-10, Lane 50, Tian Muu E. Rd., Taipei (TW)

( * ) Notice: Subject to any disclaimer, the term of this patent is extended or adjusted under 35 U.S.C. 154(b) by 126 days.

(21) Appl. No.: 10/218,503

(22) Filed: Aug. 13, 2002

(65) Prior Publication Data

US 2004/0031080 A1 Feb. 19, 2004

(51) Int. Cl.[7] ..... B63C 11/04; A61M 15/00
(52) U.S. Cl. ..... 2/2.15; 2/467; 405/186
(58) Field of Search ..... 2/2.15, 2.16, 2.17, 2/467; 405/186

(56) References Cited

U.S. PATENT DOCUMENTS 5,011,334 A * 4/1991 Vorhauer ..... 405/186
5,902,073 A * 5/1999 Eungard et al. ..... 405/187
6,477,709 B1 * 11/2002 Kawana ..... 2/2.15
6,644,522 B2 * 11/2003 Preiss ..... 224/264

* cited by examiner

*Primary Examiner*—Peter Nerbun
(74) *Attorney, Agent, or Firm*—Trojan Law Office

(57) ABSTRACT

A diving vest with adjustable buoyancy mainly has a back pad filled with a soft polyurethane gel body therein and disposed additionally on a back portion on an inner side of a regular vest; two left and right sides at the lower ends of the back pad extend respectively to form lashing waist bands; the protruding back pad leans against a human body's concave waist spine portion for obtaining a good ergonomic support and protecting the waist spine portion; the lashing waist band penetrates through a ring band on a waist bag of the vest thereby linking the waist bag to tightly lash a diver onto the vest. The lashing waist band lashes from the back pad as the beginning point such that it is more capable of tightly pulling the vest from the rear to the front for lashing the diver.

4 Claims, 6 Drawing Sheets

DIVING VEST WITH ADJUSTABLE BUOYANCY

BACKGROUND OF THE INVENTION

1.) Field of the Invention

The present invention relates to a diving vest with adjustable buoyancy, more particularly to a vest with a soft and cushioning back pad disposed additionally on a back portion on an inner side of the vest thereby making the diver feel comfortable in wearing the vest and protecting the diver's waist spine portion. Two lashing waist bands on two sides of the back pad lash extend therefrom to tightly pull the vest from the rear to the front for lashing the diver.

2.) Description of the Prior Art

Accordingly, a regular diving vest with adjustable buoyancy allows a diver to emerge, submerge or stay freely. Referring to FIG. 6, a conventional vest (100) has no back pad protecting device disposed on a back portion (B) on an inner side thereof. Lifting heavy diving equipment on the back for a long time might hurt or cause discomfort to the diver's waist spine portion on the protruding portion. Two left and right sides at lower ends of the vest (100) extend respectively to form a waist bag (101). Since the waist bag (101) lashes from the lowest end of the vest (100), it is unable to tightly pull the vest (100) from the rear side to the front or to lash the diver. Furthermore, the unitarily molded waist bag (101) is not adjustable to fit the divers with different waist sizes and that needs to be improved.

SUMMARY OF THE INVENTION

Therefore, the primary objective of the present invention is to dispose a back pad on a back portion on the inner side of the vest; a soft and cushioning polyurethane (PU) gel body fills the interior of the back pad to have a good buffering specialty such that the protruding back pad leans against a human body's concave waist spine portion ergonomically to not only provide a better support and comfort for a diver, but also protect the diver's waist spine.

Another objective of the present invention is to extend left and right sides at two lower ends of the vest respectively to form lashing waist bands which penetrate through ring bands inside a waist bag to link the waist bag thereby lashing the diver onto the vest. Since the lashing waist band extends outwardly from the back pad, it is capable of tightly pulling the vest from the rear to the front for lashing the diver.

Yet another objective of the present invention is to dispose a soft and cushioning PU gel body on the shoulder strap portion of the vest such that the soft and cushioning body makes the diver feel comfortable while using the vest to shoulder the diving equipment.

To enable a further understanding of the structural features and the technical contents of the present invention, the brief description of the drawings below is followed by the detailed description of the preferred embodiment.

DETAILED DESCRIPTION OF THE PREFERRED EMBODIMENTS

Figure 1:
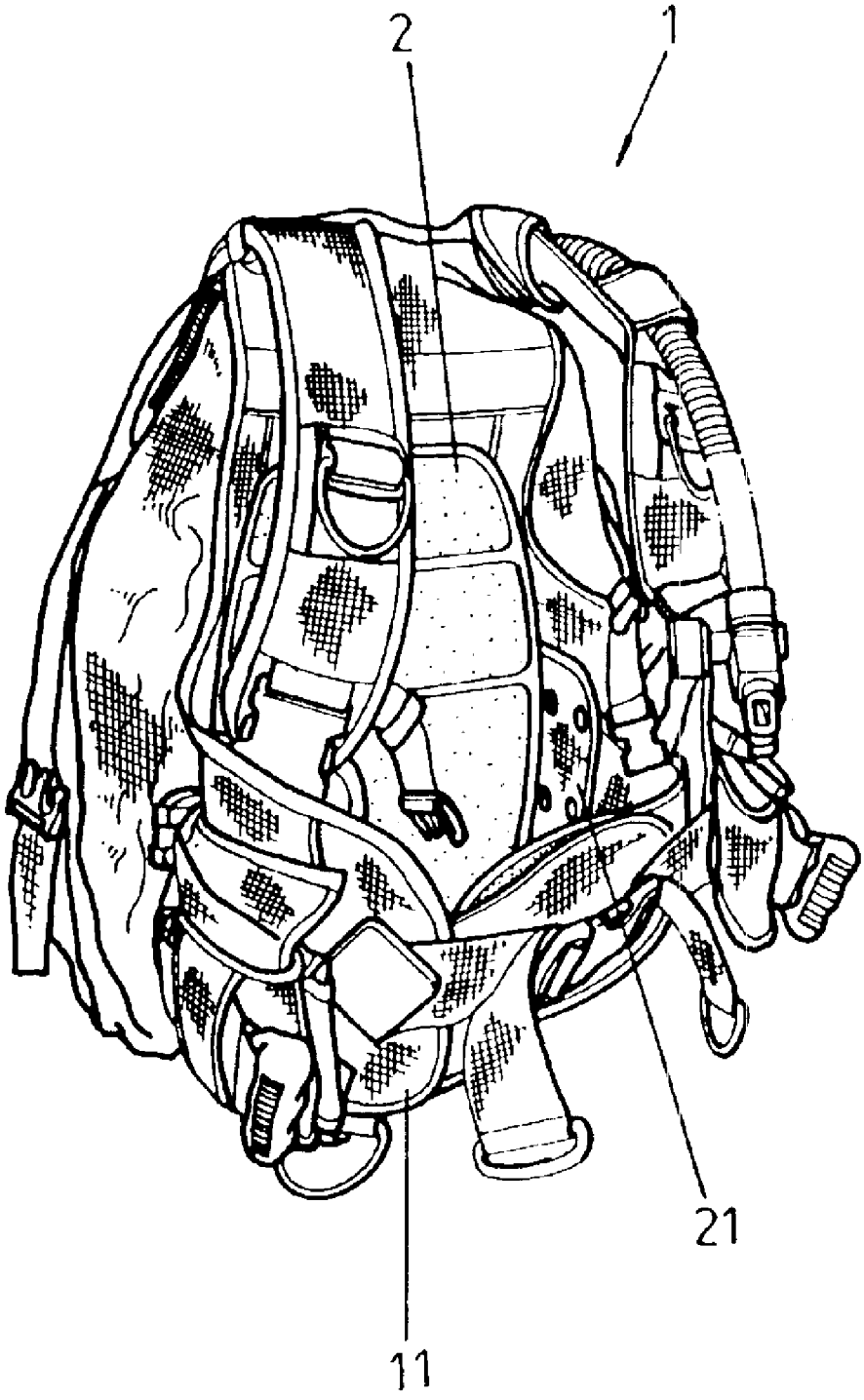
FIG. 1 is an external view drawing of the present invention.
Figure 2:
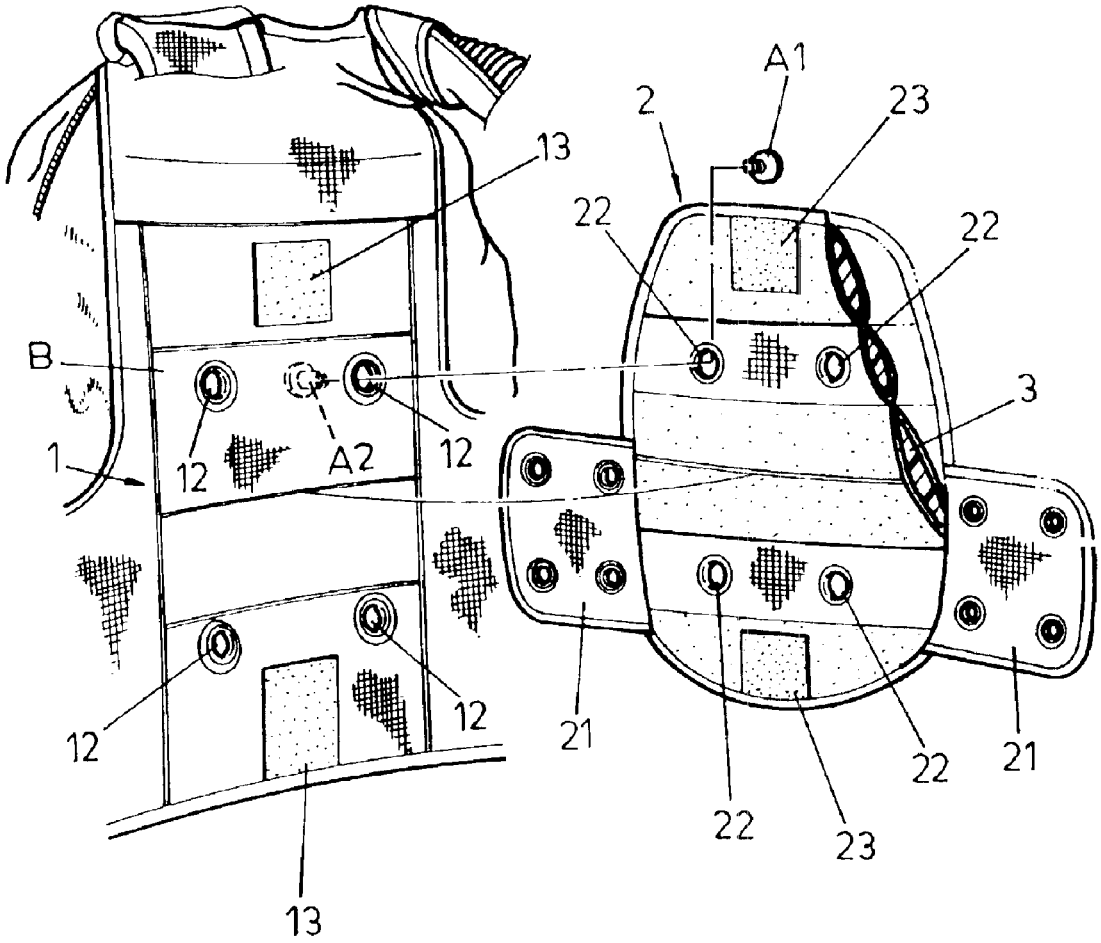
FIG. 2 is a partial exploded drawing of the present invention.

The present invention as indicated from FIGS. 1 to 4 with two left and right sides at lower ends of a diving vest (1) extending respectively to form waist bags (11) is characterized that a back pad (2) disposed with a lashing waist band (21) at both sides on a back portion (B) on an inner side of the vest (1). As indicated in FIG. 2, a plurality of bolt holes (12) and loop-and-hook bands (13) are disposed on the back portion (B) of the vest (1). The opposite positions on the back pad (2) and the vest (1) have the same number of bold holes (22) and loop-and-hook positions (23). Male and female screw bolts (A1, A2) penetrate through the bolt holes (22, 12) of the back pad (2) and the vest (1) for bolting fixedly. Furthermore, the loop-and-hook bands (23, 13) of the back pad (2) and the vest (1) are adhered fixedly to fasten the back pad (2) onto the vest (1).

Before being sewn or molded, the back pad (2) is filled with more than one soft and cushioning polyurethane gel body (3) as indicated in FIG. 2. The soft and cushioning body (3) does not absorb water or foam but works as a buffer pad with softness according to the thickness thereof. The protruding back pad (2) leans against a human body's concave waist portion on the back portion thereof ergonomically to provide better support and protect the waist spine.

Figure 3:
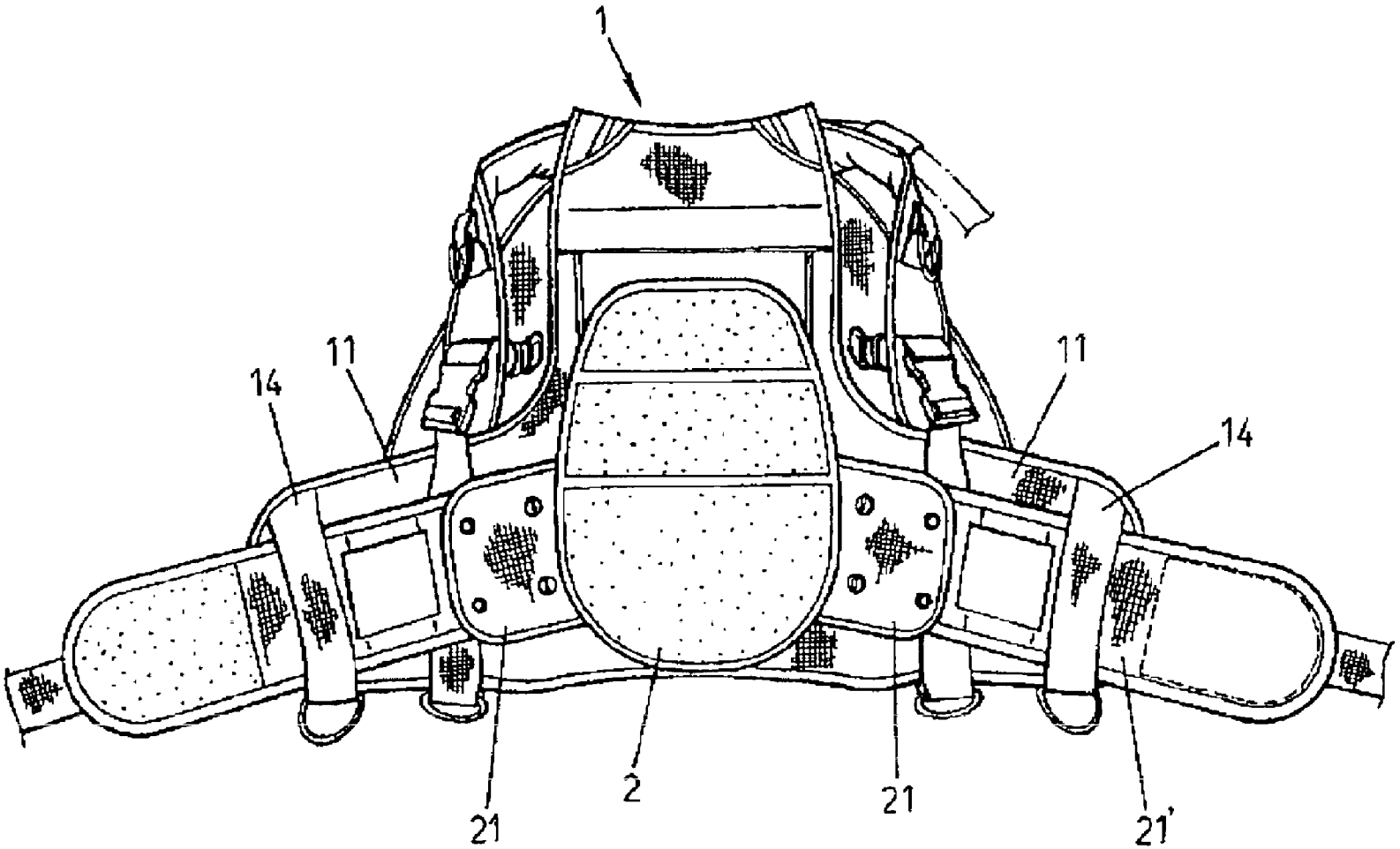
FIG. 3 is a structural drawing of a front side of the present invention.

In addition, a ring band (14), as indicated in FIG. 3, is respectively disposed on the waist bags (11) on two sides of the vest (1); the lashing waist bands (21) extended from the two left and right sides at the lower ends of the back pad (2) respectively penetrate through the ring bands (14) to link the waist bags (11) for lashing the diver onto the vest (1). The lashing waist band (21) extends from the back pad (2) as the beginning point to pull the vest (1) more tightly from the rear to the front for lashing the diver.

Figure 4:
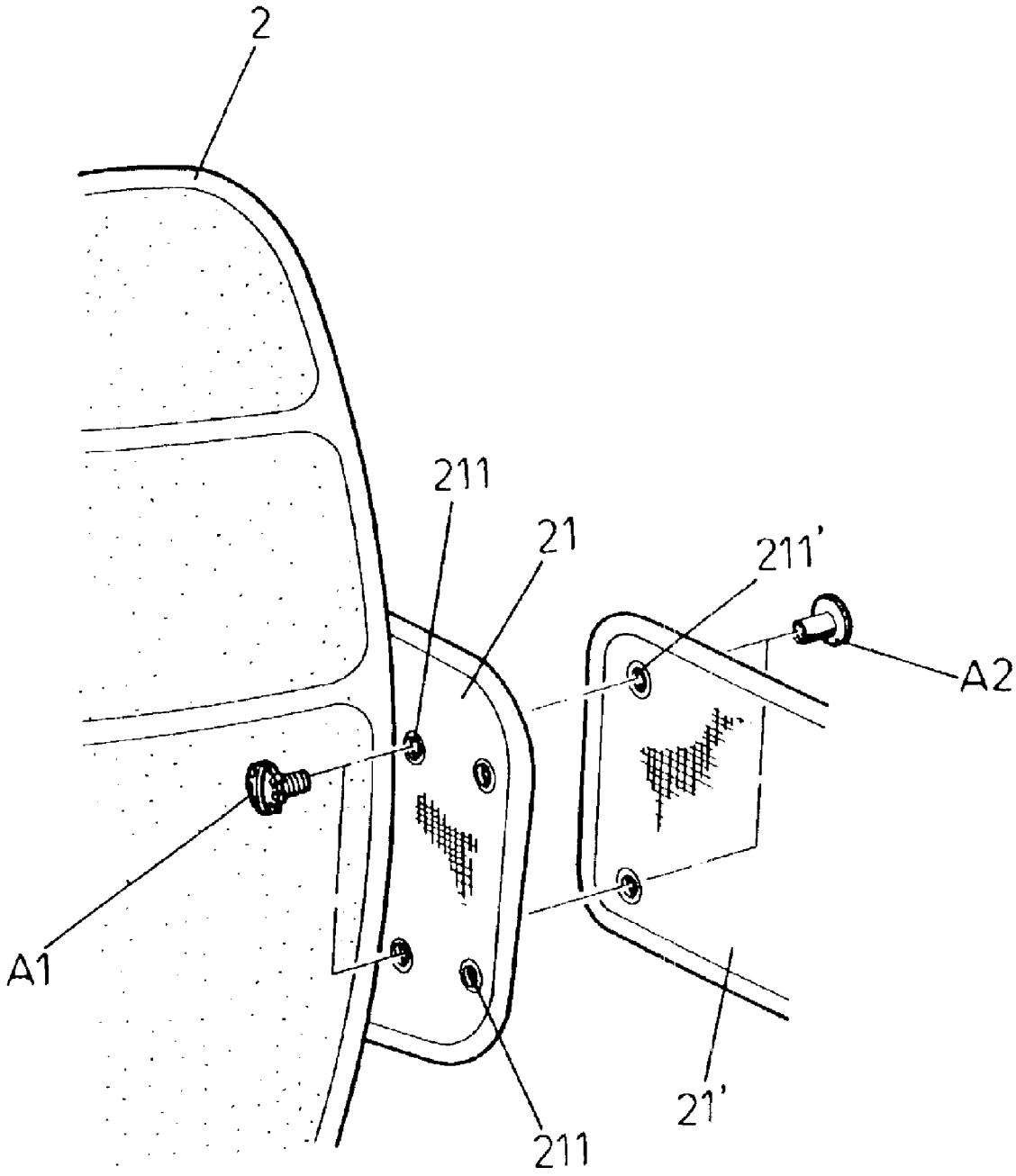
FIG. 4 is a schematic drawing of an assembly of a back pad and a lashing waist band of the present invention.

To fit the divers' different waist sizes, the lashing waist bands (21) on two sides of the back pad (2) are designed as a two-segmented and adjustable structure. As indicated in FIG. 4, the lashing waist band (21) has more than two sets of bolt holes (211); the lashing waist band (21') on the other segment is disposed with a single set of corresponding bolt hole (211'). The corresponding and overlapping relation of the two sets of bolt holes (211, 211') locks the male and female screw bolts (A1, A2).

Figure 5:
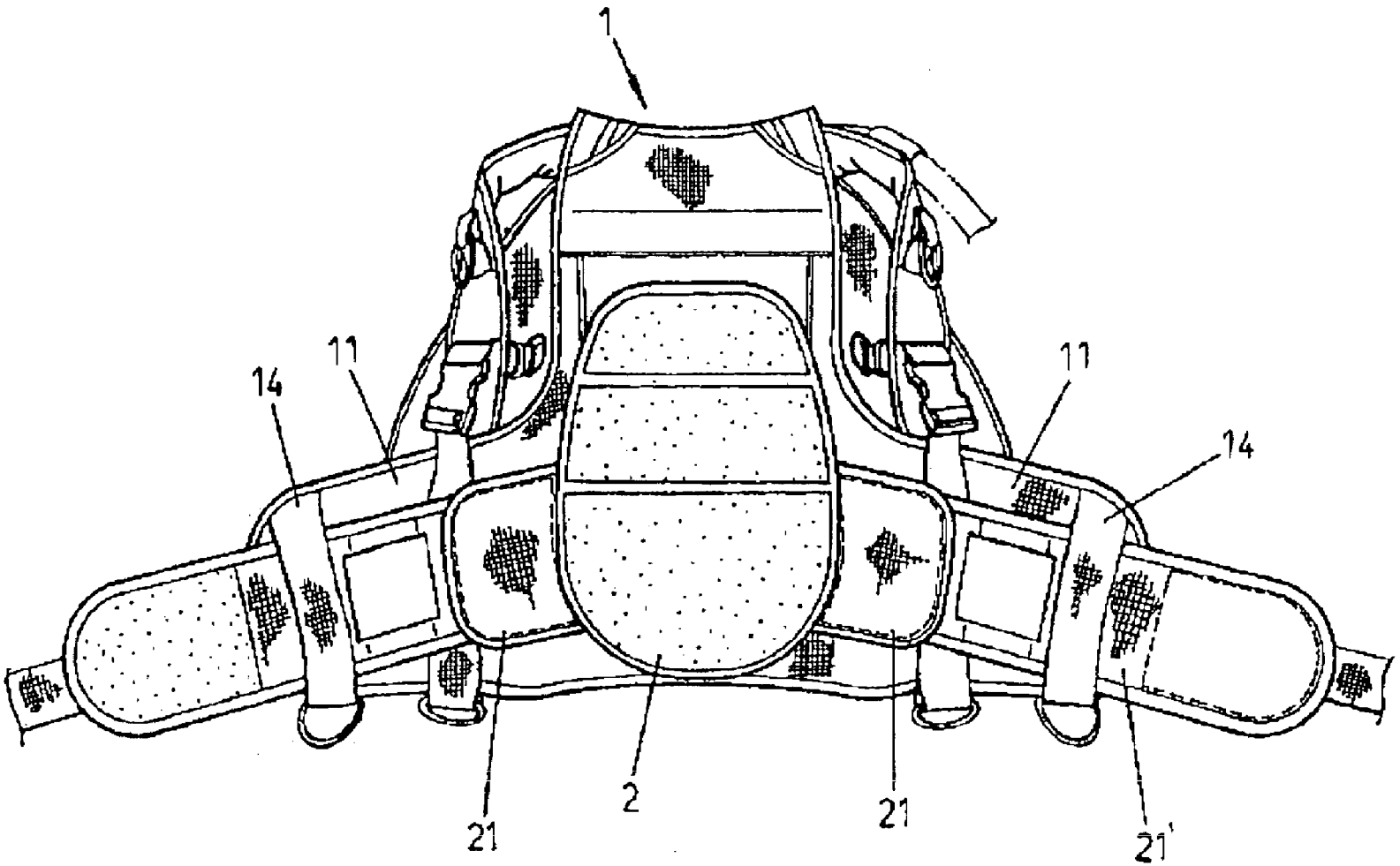
FIG. 5 is a drawing of an exemplary embodiment of the present invention.
Figure 6:
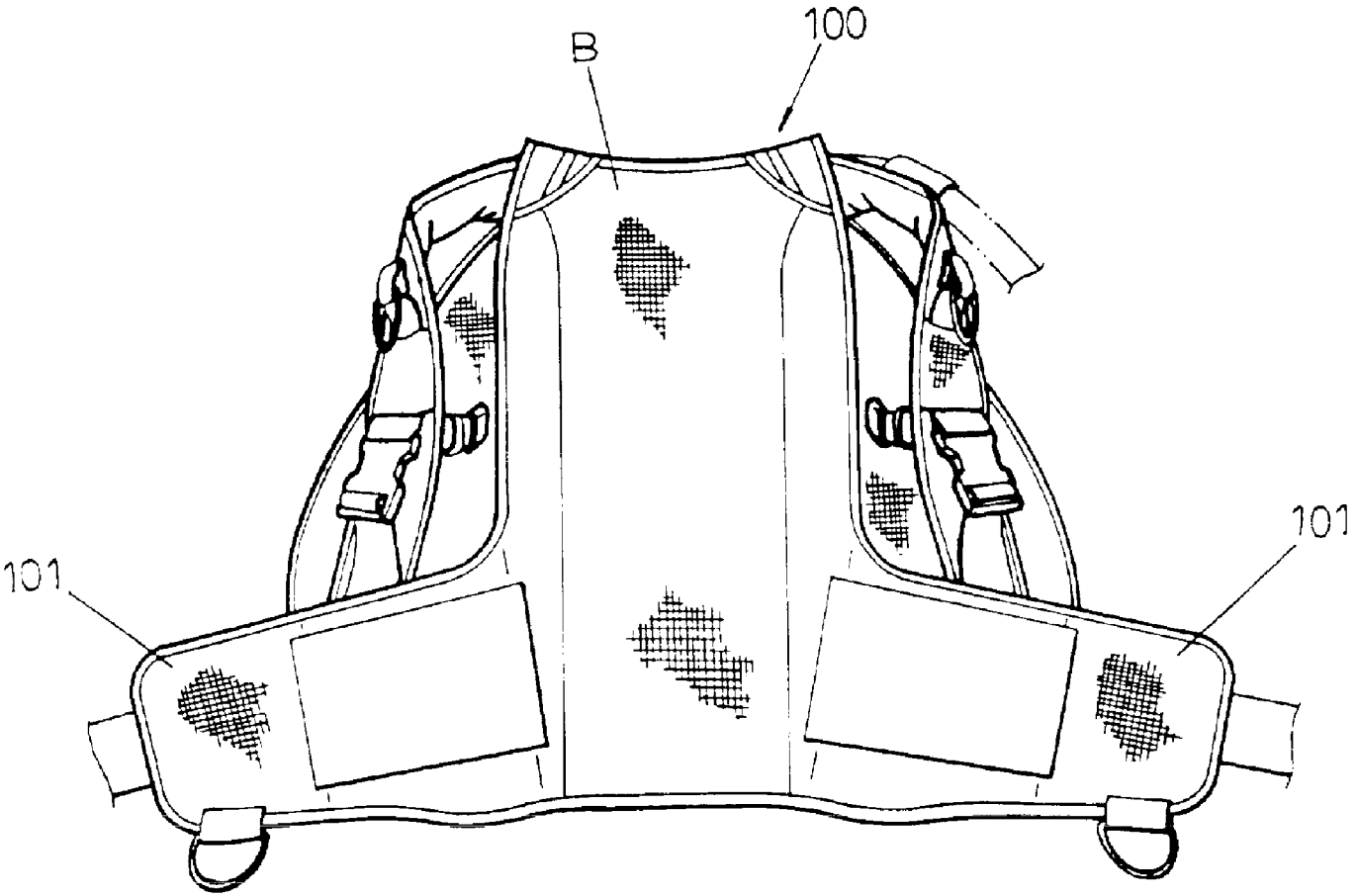
FIG.6 (PRIOR ART)
FIG. 6 is a structural drawing of a conventional product.

Furthermore, as illustrated in FIGS. 3 and 5, elastic bands (31) are included on the lashing waist bands . . . . As such, elastic bands (31) automatically tighten the lashing waist bands (21) to accommodate for the compression and allow the vest (1) to provide for a secure fit as the water pressure increase at greater depths.

As indicated in FIG. 5, the lashing waist bands (21) on two sides of the back pad (2) are single pieces and not adjustable; furthermore, the lashing waist bands (21) on two sides of the back pad (2) and the back pad (2) are designed to incline downwardly thereby increasing the lashing effect of uplifting. A soft and cushioning PU gel body (3) is disposed inside the shoulder strap portion of the vest (1) to make the diver feel more comfortable while using the vest (1) to shoulder the diving equipment.

In summation of the abovementioned, the present invention comprises a back pad disposed additionally with a soft and cushioning PU gel body on the back portion on the inner side of the vest to protect the diver's waist spine and comfort. Two sides of the back pad respectively extend to form the lashing waist bands which lash from the back pad as the beginning point thereby tightly pulling the vest from the rear to the front for lashing the diver.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A diving vest with adjustable buoyancy having two left and right sides at lower ends of said vest extended to form waist bags disposed with ring bands comprising:

a back pad on a back portion of an inner side of said vest; and a lashing waist band having two left and right sides at lower ends of said back pad, wherein said left and right sides extend at a downward angle to form said lashing waist band that penetrates through said ring bands and links said waist bags for lashing a diver onto said vest.

2. A diving vest with adjustable buoyancy having two left and right sides at lower ends of said vest extended to form waist bags disposed with ring bands comprising:

a back pad on a back portion of an inner side of said vest, wherein a soft and cushioning polyurethane (PU) gel body fills an interior of said back pad; and a lashing waist band having two left and right sides at lower ends of said back pad, wherein said left and right sides extend at a downward angle to form said lashing waist band that penetrates through said ring bands and links said waist bags for lashing a diver onto said vest.

3. A diving vest with adjustable buoyancy having two left and right sides at lower ends of said vest extended to form waist bags disposed with ring bands comprising:

a back pad on a back portion of an inner side of said vest; and a lashing waist band having two left and right sides at lower ends of said back pad, wherein said left and right sides extend to form said lashing waist band that penetrates through said ring bands and links said waist bags for lashing a diver onto said vest, wherein said lashing waist band uses a two-segmented locking method to facilitate adjusting and fitting divers with different waist sizes, and wherein said two left and right sides of said lashing waist band extend at a downward angle.

4. A diving vest with adjustable buoyancy having two left and right sides at lower ends of said vest extended to form waist bags disposed with ring bands comprising:

a back pad on a back portion of an inner side of said vest wherein a soft and cushioning polyurethane (PU) gel body fills an interior of said back pad; and a lashing waist band having two left and right sides at lower ends of said back pad, wherein said left and right sides extend to form said lashing waist band that penetrates through said ring bands and links said waist bags for lashing a diver onto said vest, wherein said, lashing waist band uses a two-segmented locking method to facilitate adjusting and fitting divers with different waist sizes, and wherein said two left and right sides of said lashing waist band extend at a downward angle.

* * * * *